United States Patent [19]

Schank et al.

[11] 4,010,687

[45] Mar. 8, 1977

[54] PLANOGRAPHIC PRINTING MASTER

[75] Inventors: Richard L. Schank, Webster, N.Y.; Richard G. Crystal, Los Altos, Calif.

[73] Assignee: Xerox Corporation, Stamford, Conn.

[22] Filed: Apr. 13, 1973

[21] Appl. No.: 351,110

[52] U.S. Cl. ..... 101/453; 101/467; 101/450; 427/261; 427/387

[51] Int. Cl.[2] ..... B41H 1/14; B41C 1/10

[58] Field of Search ..... 101/455, 463, 465, 466, 101/467; 427/261, 387

[56] References Cited

UNITED STATES PATENTS

| | | | |
|---|---|---|---|
| 2,602,025 | 7/1952 | DeGoeij et al. | 101/426 X |
| 2,895,846 | 7/1959 | Schaefer | 117/38 |
| 3,071,070 | 1/1963 | Matthews et al. | 101/466 X |
| 3,215,527 | 11/1965 | Johnson | 101/401.1 X |
| 3,554,125 | 1/1971 | Van Dorn | 101/467 X |
| 3,592,679 | 7/1971 | Tully et al. | 117/38 |
| 3,677,178 | 7/1972 | Gipe | 101/466 X |
| 3,679,410 | 7/1972 | Vrancken et al. | 250/316 X |

FOREIGN PATENTS OR APPLICATIONS

| | | | |
|---|---|---|---|
| 1,004,237 | 9/1965 | United Kingdom | 101/395 |
| 946,028 | 1/1964 | United Kingdom | 101/395 |

*Primary Examiner*—Clyde I. Coughenour
*Attorney, Agent, or Firm*—James J. Ralabate; James P. O'Sullivan; Donald M. MacKay

[57] ABSTRACT

A novel printing master and method for producing the same is disclosed which comprises; coating a suitable substrate with a layer of an ink releasable material selected from the group consisting of silicone elastomers and heterophase polymeric compositions having a silicone phase. A particulate image pattern is thereafter deposited on the layer and fused thereon to provide ink receptive image areas on said layer. The material used to provide the particulate image pattern comprises a heterophase polymeric composition also having a silicone phase, thereby providing a physically compatible image pattern for adherence to the silicone containing ink release layer.

35 Claims, 4 Drawing Figures

PLANOGRAPHIC PRINTING MASTER

BACKGROUND OF THE INVENTION

This invention relates to novel printing processes, particularly of the planographic type, to novel printing masters, method of forming these masters, as well as method of printing therefrom.

Conventional printing can be divided into broad process groups including relief printing, intaglio printing, and planographic printing. In relief printing, for example, the printing areas of the image carrier are raised above the plane of the substrate, which are then selectively inked for transfer to a copy sheet by direct impression. Intaglio printing involves substantially the reverse of this, in which printing areas are sunken in the image carrier, with nonprinting areas on the surface. The depressed printing areas carry applied ink which is removed in nonimage areas followed by transfer of the inked, depressed image to a copy sheet. Planographic printing is one of the better known types of printing and differs from either of the above two general types in that, printing and nonprinting areas are substantially in the same plane of the image carrier. Included within this type of printing are offset and direct lithography with the former depending on indirect image transfer from a carrier to a copy sheet, via a "blanket" or "impression" cylinder which rotates in contact with the image receiving surface and the image carrier, while the latter involves, as the term implies, direct transfer from the image carrier to the final copy or image receiving surface.

Direct lithography, while largely superseded commercially by offset lithography, has some advantages including usefulness in work where heavy ink films are essential, as well as a somewhat faster mode of operation than offset. However, because of direct contact between the image carrier and printing stock, abrasion of the image areas of lithographic plates can occur, thus life expectancy thereof is shortened, particularly if the "image" itself is relatively weak mechanically. Although it is now possible to obtain long production runs in direct lithography by means of bimetallic plates, on which the printing areas consist of one metal, and the nonprinting areas consist of a different metal, plates of this type did not exist during the time of most rapid growth of the printing industry and direct lithography, while of significant importance was therefore largely superseded by offset lithography.

In either the case of direct or offset lithography, a common denominator underlying either, is that printing and nonprinting areas are essentially in the same plane on the image carrier, and that the nonimage areas must be chemically treated to be ink releasable, and further that releasability in the nonimage areas must be maintained during printing by dampening the plate with a water "fountain" solution at every printing cycle. The process is thus dependent on the addition of a material such as water, which is mutually exclusive to an ink, to selective areas of the imaged plate, as well as the maintenance of a balance between ink and the water during the printing process.

Planographic plate making or the formation of the imaged master, can be accomplished in a variety of ways including using a metal substrate coated with a photosensitive layer, such as a diazo compound to form a negative or positive image of a photographically applied image, as well as bimetallic plates which once imaged with a photomechanical stencil, can be selectively etched, in image or nonimage areas to provide metals of preferential sensitization for either ink or water. A more recent innovation in the formation of planographic masters, involves the use of electrophotography or xerography to image the image carrier, in which case a latent electrostatic image is formed on the surface of a photoresponsive coating which is then developed with electroscopic toner particles to form a powder image. The developed, powder image can be then transferred to an aluminum substrate and fused thereon to provide a planograhic formation, a solution must be applied to convert the nonimaged normally ink receptive areas of the aluminum substrate to an ink repellant or releasng condition, to thus provide a background for the relatively ink receptive, deposited toner image. After alteration of the nonimage areas, the plate is then wetted with an ink which is preferentially accepted by the toner image and released by the converted hydrophilic nonimage areas.

It may, therefore, be seen that regardless of the means of imaging the planographic master, the printing system is completely dependent on the concept that a film of water which is coated over nonimage areas of a printing master, being cohesively weak, will reject an oleophilic or oil based ink. In this manner, the printing apparatus of the planographic variety, particularly of the offset type, necessitates the presence of various mechanical equipment for separate application of water based "fountain solution", as well as inks to the imaged master, including equipment to store these materials in adequate quantity for continuous operation, meter them as required during the process of the printing, transport them from the storage space to the printing image carrier, and distribute them properly as films to the surface of the image carrier. It may, therefore, be seen that a large amount of equipment is required to simply fulfill this function to say nothing of maintaining the delicate balance which exists between the mutually repellent ink and fountain solution thus creating numerous physical problems in metering and handling, both of which are constantly changing over the period of the printing run. Associated with this, are difficulties in maintaining proper consistency of the fountain solution, and preventing the ink from emulsifying by "backflow" of the fountain solution into the inking rollers during machine operation, as well as flowing of the fountain solution onto the offset cylinder, thus moistening the image receiving sheet causing it to curl and change dimension. Therefore, the formulation of the fountain solution referred to above, for overcoming some of these problems has become a difficult and demanding art. Planographic printing, therefore, in spite of numerous advances made therewith, is still largely dependent on operator skill in controlling the balance between ink and fountain solution, both initially and during the constantly changing conditions of the printing run. Furthermore, as opposed to complete elimination of the fountain solution, most advances in the art have been directed towards means of applying the fountain solution, or in controlling the application of it to overcome complete dependency on the skill of the operator to solve the attendant problems.

A different approach to overcoming the problems with fountain solutions other than the above, which is promulgated in U.S. Pat. Nos. 3,511,178, 3,677,178, 3,606,922 and 3,632,375, involves complete elimination of the need for a fountain solution or for the application of "water" to release the ink in nonimage areas. This is accomplished by using a described "abhesive" background for the ink receptive image which is substantially ink releasable without regard to whether or not it is impregnated with aqueous fountain solution. This abhesive background which is releasing to the printing ink actually keeps the ink from splitting away and transferring from the inking rollers, thus obviating a need for the fountain solution to repell the ink. This type of planographic system has therefore been characterized as a "dry" or "waterless" planographic printing system. The abhesive background in plates of this type is provided by cured silicone gums or silicone elastomers, which when dry, without being wetted by water, will not accept printing ink from an inking roller in contact therewith. On the other hand, although the need for fountain solutions has been obviated by abhesive materials of this type, nevertheless, a plate which utilizes these materials to provide ink releasable areas presents imaging problems, since the very properties of the silicone elastomer which prevents the ink from adhering to its surface also acts to prevent particulate image patterns such as toner image patterns from readily adhering to the surface thereof. Thus, the procedures normally available to sensitize lithographic masters are not suitable for planographic plates having a cured silicone elastomer coating, since various diazo sensitizers or photographic developers do not adhere well to such a surface. Therefore, the above patents for the most part, overcome this problem, by constructing multilayered structures with a photosensitive layer between or overlying abhesive layer. In this manner, upon light exposure, exposed photosensitive image areas can either remain in a soluble form which is easily abraded or washed off, or be converted to an insoluble form with the nonimage areas being removed. In this manner, the substrate becomes exposed in areas where removal takes place providing ink receptive areas, against the ink releasable elastomer background.

Any of the imaging systems which have heretofore been proposed with this type of planographic plates, employs photographic techniques which necessitate either additional mechanical or chemical treatment, as well as extremely long exposure times to produce an image. This not only reduces the speed involved in a complete printing operation, which includes preparation of the master, but requires the use of a planographic plate that must be carefully constructed to have a photosensitive layer, an abhesive layer and a means for securing adhesion between these two layers, in order to provide for proper imaging as well as a long life in continuous printing.

Considering the methods of imaging, available for reproduction, electrophotography and related techniques offer an advantage of simplicity, photosensitivity and speed, which are generally unavailable to conventional photographic imaging techniques. It would therefore be highly desirable if imaging techniques of this type could be adapted to provide ink receptive image areas for abhesive ink releasable elastomers of the type noted above. In this manner, production of printing masters could be greatly simplified, thus eliminating the need for complex photographic techniques in plate production. For example, since electrophotographic images are "developed" with toner particles, on a photoreceptive surface, this developed electrostatic image could be in principle easily transferred to an abhesive surface to provide a printing master, thus eliminating the need for any type of photosensitive layer in the abhesive coating for image formation.

In U.S. patent applications, Ser. Nos. 351,041, 351,129, and 351,130, filed Apr. 13, 1973, novel printing masters and methods for their production are disclosed. The processes disclosed therein utilize the properties of a silicone gum precursor of a silicone elastomer, to provide a surface for the adherence of a particulate image pattern, thereby overcoming the difficulties of employing a cured elastomer as the receptive surface for a particulate image pattern. Although the noted processes are highly suitable for the production of printing masters, nevertheless, they are entirely dependent on a "post curing" step to convert the silicone gum to an elastomeric condition and thereby provide a surface that is suitable for printing purposes. The elimination of this and other steps from such a process, thus represents a highly desirable goal.

It is therefore an object of the instant invention to provide a novel imaged, printing master suitable for printing purposes, particularly planographic printing.

It is also an object of the instant invention to provide a method of producing such a printing master, having an ink releasable surface and useful in printing applications, which is not dependent on a "post curing" step to provide an ink releasable surface.

Another object is the inclusion on the printing master having an ink releasable surface, of an image which is ink receptive and capable of use in planographic type printing applications.

Still a further object of the instant invention is the provision of imaging the printing master having an ink releasable surface with a developed electrostatic image, thereby providing an imaged master which is capable of planographic reproduction.

Another object of the instant invention involves a process for printing, using a member imaged with a particulate image pattern having an ink releasable surface, and an ink receptive image which performs in a planographic type printing system without the need for an aqueous fountain solution to provide background areas of ink releasability.

Another object is therefore the provision of an offset or direct lithographic printing process which eliminates the need for an aqueous fountain solution to provide ink release in nonimage areas of the master.

SUMMARY OF THE INVENTION

The present invention involves a method for producing a novel printing master which comprises; coating a suitable substrate with an ink releasable material selected from the group consisting of silicone elastomers and heterophase polymeric compositions having a silicone phase, followed by the deposition of a particulate image pattern on said layer. In the instant invention the material which provides the particulate image pattern consists of a heterophase polymeric composition which is ink receptive having a silicone phase. The deposited particulate image pattern can be fused to the layer of "ink releasable" material to provide ink receptive image areas on the layer suitable for printing, in the absence of water or fountain solution.

Specifically, in the present invention, a silicone containing heterophase polymeric composition is employed as the particulate material which has been determined to have the specific advantage of improved adherence to ink releasable surfaces such as silicone elastomers and heterophase compositions having silicone as a phase. This advantage provides a means to produce a printing master absent any type of "curing" or crosslinking step for permanentization of the applied image pattern. The physical compatibility of the silicone containing particulate imaging material with the image receiving surface presumably provides a means of holding a fused particulate image pattern on such a surface for printing purposes without immediate stripping of the image during inking, as would normally occur in the absence physical compatibility of the particulate material with the image receiving surface.

Although, the heterophase polymeric composition for the particulate material can be substantially similar to that of the ink releasable layer nevertheless it must be ink receptive since it will provide the image areas for the otherwise ink releasable image receiving surface of the printing master. This can optionally be achieved by the addition of normally ink receptive pigments to the particulate image material during its formulation to provide the particulate material with ink receptive properties.

After application of the particulate image pattern to the ink releasable surface of the printing master, fixing of the image pattern is carried out thereby promoting adhesion between the layer and the image pattern. Adhesion of the particulate image pattern is promoted by the existence of physically compatible phases in both the particulate material as well as the ink receiving surface. The fused image pattern on the layer thereby provides ink receptive sites on the ink releasable layer permitting inking and printing of the formed master in the absence of fountain solution.

DESCRIPTION OF THE PREFERRED EMBODIMENTS

Figure 1:
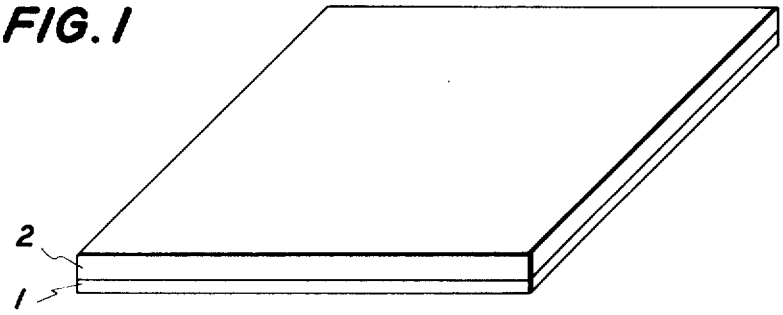
FIG. 1 depicts the formed printing master of the instant invention and its structure.

Referring specifically to FIG. 1, the printing master and method of producing the same comprises a suitable substrate 1 which can generally be any suitable type of self supporting material including metals, plastics, paper, etc., examples of which include aluminum, and other metals, polyester, polycarbonate, and polysulfone, nylon and other relatively heat stable polymeric materials, etc. The only functional requirement for the substrate being that it provides for sufficient adherence of the applied ink release layer, as well as possess sufficient heat and mechanical stability to permit use under widely varying printing and handling conditions. The present invention is therefore not intended to be limited with regard to the specific material suitable for the substrate, provided that it meets the above noted functional requirements.

The substrate is then provided with a layer of an ink releasable material 2. Materials which are suitable include cured organopolysiloxanes or silicone elastomers as well as organopolysiloxane copolymers including block copolymers, graft copolymers, segmented copolymers and, shaded copolymers, organopolysiloxane polymer blends and copolymer stabilized polymer blends. Depending on the material, it may or may not be cured which is to say that it has some degree of chemical crosslinking, in which case it is coated on the substrate as an "uncured" material and then crosslinked or cured.

The thickness of the ink releasing layer will, of course, vary depending on the choice of materials and mechanical properties desired, and the present invention is not intended to be limited in this respect. Typically, therefore, the ink release layer will have a thickness of between about 0.1 to 50 microns, and preferably between about 0.5 to 15 microns.

Optionally, an adhesive interface layer may be provided between the ink releasable surface 2 and the substrate 1 to improve adhesion of the ink release layer to the substrate as well as improve the flexibility and mechanical properties of the printing master. The particular types of material which are suitable for this optional layer include various adhesive materials such as the polyester resins, urethanes, and other materials of known adhesive properties. It is, however, desirable to avoid using a material which will degrade under the conditions of printing, and possibly disrupt the ink release characteristics of the ink releasable surface 2. The thickness of this optional layer is further noncritical to the practice of the instant invention.

Among the various types of materials, noted to be suitable as an ink releasing surface in the present invention are the cured organopolysiloxanes or silicone elastomers, with the term cured referring specifically to the material in a crosslinked condition, or the chemical or physical connection of adjacent linear polymer chains by means of a crosslinking species or moiety. The density of crosslinking for the elastomer can, of course, vary with this intended to refer to the number of monomer units in the polymer from which crosslinks originate in relation to the total number of monomer units.

In this regard, two general methods are involved in the curing or crosslinking or silicone elastomers the first of which is the incorporation of a curing agent into a silicone gum composition and then activating the curing agent through the application of heat to cure the gum to an elastomer. Elastomers cured by this type of process are referred to as heat cured or thermosetting elastomers. Typical curing materials include either catalytic materials such as organic peroxides to stimulate the production of reactive sites on the polymer, or various reactive species which an participate in a stoichiometric reaction with the copolymer units, included among which are various types of blocked disocyanates. The second general method of curing silicone elastomers is by carrying out the curing at ambient temperature and under atmospheric conditions thus requiring incorporation of certain materials in the silicone gum to achieve this purpose. Elastomers of this type are generally referred to as the room temperature vulcanizable or RTV silicones. The resultant silicone elastomers cured by either process have been found to provide a suitable ink releasing background for the deposited particulate image pattern thereby yielding a printing master of highly desirable printing characteristics.

Other types of materials which have been found to be suitable as the ink releasing layer include other elastomeric materials among which are organopolysiloxane copolymers including diblock and triblock copolymers, multiblock copolymers and graft copolymers, segmented copolymers, shaded copolymers, polymer blends, and copolymer stabilized polymer blends.

These ink releasable copolymers comprise heterophase polymeric compositions consisting of an organpolysiloxane material and a nonsilicone polymeric material. Polymeric materials which can be employed as a component of the heterophase polymeric composition and suitable for use in the present invention include thermoplastic materials such as poly($\alpha$-methylstyrene), polystyrene, polyesters, polyamides, acrylic polymers, polyurethanes, and vinyl polymers. The present invention is not intended to be limited by the material for this phase with the exception that if this phase is in an amorphous state it should have a glass transition temperature (Tg) of at least about ambient temperature to provide a heterophase composition of sufficient mechanical strength for printing. If in a crystalline state its melting point should also be at least about ambient.

While not limiting, preferred ink release properties of the heterophase polymeric composition of the instant invention requires a ratio by weight of between about 95 to 50 parts of the silicone phase to 5 to 50 parts of nonsilicone polymer. Over this ratio of silicone phase to nonsilicone polymer, the resultant heterophase composition produces a flexible layer of good mechanical stability for printing as well as optimum ink release properties.

Particularly preferred copolymers having a silicone phase, include the diblock and multiblock copolymers of an organopolysiloxane with polystyrene and poly($\alpha$-methylstyrene). Copolymers of this type and methods for their preparation are described in *I* and *EC Product Research and Development*, Volume 10, Page 10, (March, 1971) and *Macromolecules*, Volume 3, Page 1, (January–February, 1970), respectively.

As previously noted, copolymers of this type are not dependent on "post curing" or crosslinking which is necessary for the formation of the silicone elastomers from the silicone gums nor upon the addition of "crosslinking" agents to achieve this condition. They, in fact have been found to be ink releasable without the need for curing to convert them to an ink releasable condition. These materials could thus be characterized as physically crosslinked elastomers at ambient temperatures.

These materials are elastomeric in character in the absence of chemical crosslinking because the segments of the molecule which are nonsilicone and if in an amorphous state have a glass transition temperature (Tg) above ambient act as the points for the matrix and associate with one another to form the heterophase composition. The heterophase composition remains intact at ambient conditions and will not allow polymer chains to flow past one another although the soft segments can elongate thus imparting elastomeric properties to the materials.

The materials which will provide the ink releasable surface, are applied in a conventional manner, i.e. by solvent casting or dip coating of the substrate or similar techniques, after dissolution in organic solvents which typically may be solvents such as benzene, hexane, heptane, tetrahydrofuran, toluene, xylene, as well as other common aromatic and aliphatic solvents. The resultant ink release material after coating on the substrate is then cured or crosslinked to elastomeric condition if such is required to convert the surface to a mechanically strong ink releasable condition.

Typical silicone gums which are of the heat curing or thermosetting type suitable for use in the instant invention include Y-3557, Y-3502, W-892 silicone gums available from Union Carbide Company, New York, New York as well as No. 740, No. 4413 silicone and No. 4427 heat curable silicone gums available from General Electric Company, Waterford, New York. Other typical materials which are suitable include Dow Corning S2288 silicone gum, available from Dow Corning Corporation, Midland, Michigan. The Y-3557 and Y-3602 gums specifically have aminoalkane crosslinking sites in the polymer backbone which react with a diisocyanate crosslinking agent over a wide range of temperature and time to produce a durable, ink releasable elastomeric film. The time and temperature relationship for crosslinking of all of these different types of gums is controlled by the chemistry of the crosslinking agent employed and a large choice of agents are available for this purpose. The present invention is therefore not intended to be limited with respect to either time or curing temperature of these materials, or the specific materials used to achieve crosslinking, although heating at temperature between about 50° C and 300° C will typically cure or convert the silicone gum to an ink releasable silicone elastomer.

In the event the RTV silicone gums are employed singularly or in a mixture with a thermosetting gum, typical materials which are suitable include RTV-108, 106, 118 (silicone gums) available from General Electric Company, Silicone Products Division, Waterford, New York. These gums are somewhat tacky for a short period of time, and capable of thereafter being cured to a crosslinked elastomeric state by standing at ambient temperatures and with exposure to atmospheric moisture.

Figure 2:
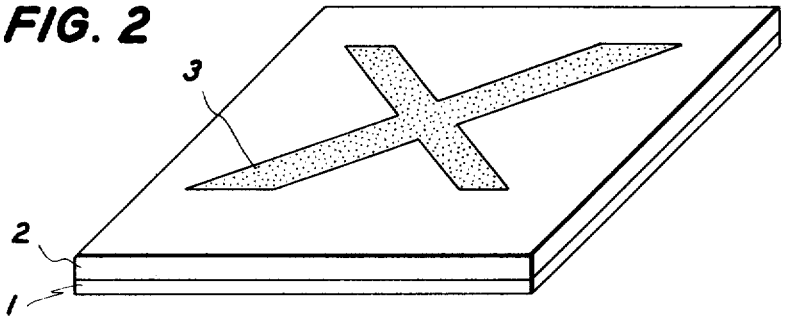
FIG. 2 depicts the printing master of the instant invention imaged with a particulate image pattern.
Figure 3:
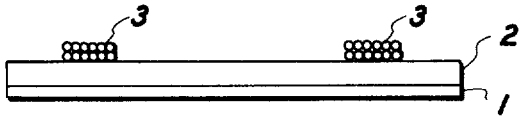
FIG. 3 illustrates a side view of the printing master of the instant invention imaged with a particulate image pattern.

Following application of the ink releasable material to the substrate and curing thereof, and with particular reference to FIG. 2, a particulate image pattern 3, such as a toner image pattern, is deposited on the surface of the ink releasable layer, said image pattern corresponding to a latent image such as a latent electrostatic image, which is preferably developed on a separate photoconductive surface and transferred to the ink releasing surface by electrostatic transfer or similar means. The method of forming the deposited image pattern can, of course, be achieved by a variety of techniques including electrophotography which involves the electrostatic charging of a photoconductive insulating layer, followed by exposure to a pattern of activating radiation such as light, which selectively dissipates the charge in the illuminated areas of the photoconductive insulating layer while leaving a latent electrostatic image in the nonilluminating areas. This latent electrostatic image may then be developed to form a visible image by depositing finely divided electroscopic marking particles on the surface of the photoconductive insulating layer.

Alternate means of providing the particulate image include electrostatic printing and electrographic imaging as described in U.S. Pat. No. 3,563,734, and other means of forming the resulting particulate image pattern for imaging of the ink releasable surface include photoelectrophoretic imaging as generally described in U.S. Pat. No. 3,384,566, U.S. patent application, Ser. No. 104,398, filed Jan. 6, 1971, and U.S. patent application, Ser. No. 104,398, filed Jan. 6, 1971, which is now abandoned. Migration imaging techniques as set forth in U.S. application Ser. Nos. 837,591 and 837,780, both of which were filed June 30, 1969, may also be employed to yield a particulate image pattern which can be applied to the ink releasable surface and thereby provide image areas therein for printing purposes.

Insofar as development of the electrostatic image, means of development will be dictated by the particular imaging technique, but insofar as conventional xerography, cascade development as set out in U.S. Pat. Nos. 2,618,551 and 2,618,552, powder cloud development as described in U.S. Pat. Nos. 2,725,305 and 2,918,910 and magnetic brush development as in U.S. Pat. Nos. 2,791,149 and 3,015,305, of course, be employed.

The present invention is specifically directed towards the material employed to develop the latent image and provide a particulate image pattern 3 for deposition on the ink releasable layer 2. By employing a heterophase polymeric composition having a silicone phase as the particulate image material, an image is provided which more readily adheres to the ink releasing layer which at the very least has a silicone phase. This is believed to be due in part to physical compatibility of the silicone phase of the particulate material with the ink releasable layer. The particulate image pattern provided with this material more readily adheres to the ink releasable layer for printing purposes and is not stripped or removed from the layer by action of an inking device as would occur absent the silicone phase in the particulate material.

The heterophase polymeric composition used for the particulate image pattern has a silicone phase to provide physical compatability with the silicone phase of the ink release layer. The silicone content of the particulate imaging material of the instant invention should be at least about 5% by weight, and the particular amount employed is not otherwise intended to be limiting. Depending on the silicone content of the particulate imaging material, it may be necessary to improve the ink receptive properties of it in order to provide the best degree of contrast when the mask is employed for printing. In this respect, an ink receptive compound can be added if necessary to improve the ink receptive properties of the heterophase polymeric composition used for the particulate imaging material.

Typical ink receptive components include carbon black, silica, colloidal silica, kaolin, iron oxide, and aluminum, all of which may be added if necessary in amounts varying between about 4 to 50% by weight of the heterophase composition. A preferred amount would be at least about 8% by weight of the heterophase polymeric composition employed for the particulate imaging material.

In the preparation of the particulate material of the instant invention, and if an ink receptive component is to be added the ingredients are thoroughly mixed to form a uniform dispersion of the pigment in the heterophase composition and the mixture is thereafter finely divided to form the desired particulate material. The mixing may be done by various means, including combination of the steps of blending, mixing, milling, and spray drying.

Thereafter, and insofar as electrophotography in particular, the particulate material may be mixed with a carrier composition as is disclosed in U.S. Pat. No. 2,618,551 to provide a means of developing latent electrostatic images as previously described.

Figure 4:
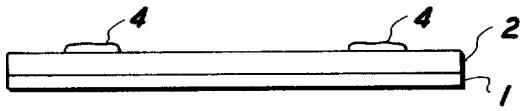
FIG. 4 illustrates a side view of the printing master of the instant invention when suitable for printing, having ink receptive image areas.

Following the application of the particulate image pattern 3 to the ink releasable layer 2 and with reference to FIG. 4, fixing of the image pattern is carried out to provide a cohesive stable image 4 that is ink receptive and suitable for printing. The specific fusion technique to form a cohesive image pattern may be either heat pressure, or vapor fixing or combinations thereof. Either of these techniques are well known in the art of electrophotography for providing a cohesive toner image pattern.

The "imaged" printing master may thereafter be employed in a planographic printing operation, including both direct and offset lithography with the dampening system removed, and employed in a continuous printing operation to provide acceptable prints. Inking of the master can be carried out with any suitable type of inking device as is conventionally employed with direct or offset lithographic apparatus.

Typical inks which would be suitable for use in the instant invention will be dependent specifically on the properties of the particulate image pattern and the degree to which it will be wet by the ink of choice. Preferred inks include glycol, and rubber based inks as well as those of the oleophilic type, which have the vehicle component for the ink pigments derived from various oleophilic materials such as aromatic and aliphatic hydrocarbons, drying oil varnishes, lacquers, and solvent type resins. Other specific types of inks which would be suitable include those generally described in *Printing Ink Technology*, by E. A. Apps, (1959) Chemical Publishing Company, New York, New York.

The ink release layer of the printing master of the instant invention thus provides background areas or nonimage areas which are not in any way dependent on the application of an aqueous fountain solution to prevent printing in the background areas and the resultant printing master is capable of operating without a dampening apparatus.

Having thus generally described the instant invention, the following examples describe the instant invention in more specific embodiments although the following examples are not intended to be limiting insofar as the scope of the instant invention.

EXAMPLE I

A printing master was prepared by dissolving a silicone gum Dow Corning Silastic 430 with a 3% 2,4-dichlorobenzyl peroxide crosslinking agent in xylene at a 10% solids level and then coating this on an aluminum substrate. The coating was permitted to dry, after which the gum was cured to an elastomer by heating at 190° C.

A particulate imaging material was prepared by coupling functionally terminated 7800$\overline{M}$n polydimethylsiloxane and 35,000 $\overline{M}$n polystyrene to provide a triblock copolymer of the two phases with relative proportions of silicone phase to nonsilicone phase of about 30 to 70 by weight. The polymer was dissolved in tetrahydrofuran in an amount of 10%/100ml and carbon black was added in an amount of 5% by weight of the polymer to provide a suspension of the carbon black in the polymer solution. The resultant suspension was spray dried to provide a particulate imaging material which was then used to form a two component developer as generally described in U.S. Pat. No. 2,618,551.

Thereafter, using a Xerox Model D Processor, a latent electrostatic image was formed, cascade developed with the above formed particulate material and electrostatically transferred to the substrate with the layer of silicone elastomer. The master with applied image pattern was then heat fused for 2 minutes at 150° C to provide a cohesive image pattern.

The fused master was then hand inked with Pope and Gray No. 2441 lithographic ink available from Pope and Gray, Division of Martin Marietta Corporation, Clifton, New Jersey, from which prints were made.

EXAMPLE II

A printing master was prepared by dissolving a heterophase polymeric composition in xylene at a 10% solids level, comprising a dimethylsiloxane/α-methylstyrene (90/10) and multiblock copolymer available from Dow Corning Corporation, Midland, Michigan. Thereafter, this solution was coated on an aluminum substrate and dried at 75° C for 5 minutes.

Two lots of particulate imaging material were prepared by using a 60% polydimethylsiloxane 40% polystyrene multiblock copolymer and milling this with a cyan pigment at 4% by weight of the polymer for Lot No. 1 and 8% by weight of the polymer for Lot No. 2. Milling was carried out in a Brabender Plasticorder at 200° C until the polymer was fluid, viscosity reached a minimum and the color of the fluid material was uniform. Thereafter, the mixture was permitted to cool and ground with steel balls in a Segvani Attritor and in the presence of liquid nitrogen for about 1 hour. The two lots of particulate material were then used to provide two component developers as generally described in U.S. Pat. No. 2,618,551. The particulate material designated as Lot No. 1 was used to form developer No. 1 and the material designated as Lot No. 2 was used to form developer No. 2.

Thereafter, using a Xerox Model D Processor, latent electrostatic images were formed which were cascade developed with developer No. 1 and developer No. 2. The developed images were electrostatically transferred to the substrate with the applied layer of silicone containing block copolymer. The master with applied image pattern was then heat fused for 2 minutes at 150° C to provide cohesive image patterns.

The fused master was then hand inked with VanSar-Holland 10850 ink and when the master was operated on an A. B. Dick press in an offset mode, prints of low background were obtained from both image patterns.

Having described the present invention with reference to these specific embodiments, it is to be understood that numerous variations may be made without departing from the spirit of the present invention, and it is intended to encompass such reasonable variations or equivalents within its scope, limited only by the appended claims.

What is claimed is:

1. A method of producing a printing master comprising:

a. providing a suitable substrate;

b. coating said substrate with a layer of an ink releasable material selected from the group consisting of silicone elastomers and heterophase polymeric compositions having a silicone phase;

c. depositing a particulate image pattern on said layer, said image pattern comprising an ink receptive heterophase polymeric composition having a silicone phase; and d. fusing said image pattern on said layer whereby said image pattern provides ink receptive areas.

2. A method as set forth in claim 1 wherein said layer has a thickness of between about 0.1 and 50 microns.

3. A method as set forth in claim 1 wherein said heterophase polymeric composition is selected from the group consisting of organopolysiloxane copolymers and organopolysiloxane polymer blends.

4. A method as set forth in claim 3 wherein said organopolysiloxane copolymers comprise copolymers of organopolysiloxane and a polymeric material in an amorphous state having a glass transition temperature of at least about ambient temperature.

5. A method as set forth in claim 3 wherein said organopolysiloxane polymer blends comprise a mixture of an organopolysiloxane and a polymeric material in an amorphous state having a glass transition temperature of at least about ambient temperature.

6. A method of producing a printing master, as set forth in claim 1 wherein said heterophase polymeric composition for said ink release layer comprises between about 95 to 50 parts by weight of an organopolysiloxane.

7. A method as set forth in claim 1 wherein an adhesive interface layer is provided between said layer of silicone containing heterophase polymeric composition and said substrate.

8. A method of producing a printing master comprising:

a. providing a suitable substrate;

b. coating said substrate with a layer of an ink releasable heterophase polymeric composition having a silicone phase;

c. depositing a particulate image pattern on said layer, said image pattern comprising a heterophase polymeric composition having a silicone phase, said image pattern composition including an added ink receptive component; and d. fusing said image pattern on said layer whereby said image pattern provides ink receptive areas.

9. A method as set forth in claim 8 wherein said layer has a thickness of between about 0.1 and 50 microns.

10. A method as set forth in claim 8 wherein said heterophase polymeric composition is selected from the group consisting of organopolysiloxane copolymers and organopolysiloxane polymer blends.

11. A method as set forth in claim 8 wherein said heterophase composition comprises a copolymer of an organopolysiloxane and a polymeric material in an amorphous state having a glass transition temperature of at least about ambient temperature.

12. A method as set forth in claim 8 wherein said heterophase composition comprises a mixture of an organopolysiloxane and a polymeric material in an amorphous state having a glass transition temperature of at least about ambient temperature.

13. A method of producing a printing master, as set forth in claim 8 wherein said heterophase polymeric composition for said ink release layer comprises between about 95 to 50 parts by weight of an organopolysiloxane.

14. A method as set forth in claim 8 wherein an adhesive interface layer is provided between said layer of silicone containing heterophase polymeric composition and said substrate.

15. A method as set forth in claim 8 wherein said ink receptive compound is present in an amount of between about 4% and 50% by weight of said heterophase polymeric composition employed for said particulate imaging material.

16. A method of producing a printing master comprising:

a. providing a suitable substrate;

b. coating said substrate with a layer of an organopolysiloxane copolymer;

c. depositing a particulate image pattern on said layer; said image pattern comprising a heterophase polymeric composition having a silicone phase; and d. fusing said image pattern on said layer whereby said image pattern provides ink receptive areas.

17. A method as set forth in claim 16 wherein said organopolysiloxane copolymer is selected from the group consisting of diblock and multiblock organopolysiloxane copolymers.

18. A method as set forth in claim 17 wherein said diblock and multiblock copolymers comprise copolymers of an organopolysiloxane and polystyrene.

19. A method as set forth in claim 17 wherein said diblock and multiblock copolymers comprise copolymers of an organopolysiloxane and poly($\alpha$-methylstyrene).

20. A method as set forth in claim 16 wherein an adhesive interface layer is provided between said layer of organopolysiloxane copolymer and said substrate.

21. A method as set forth in claim 16 wherein said organopolysiloxane copolymer comprises a copolymer of an organopolysiloxane and a polymeric material in an amorphous state having a glass transition temperature of at least about ambient temperature.

22. A method as set forth in claim 16 wherein said organopolysiloxane copolymer comprises between about 95 to 50 parts by weight of an organopolysiloxane.

23. A method as set forth in claim 16 wherein fusion is carried out by exposure of said image pattern to a solvent vapor.

24. A printing master having image areas of ink receptivity and non-image areas of ink releasability, comprising; a substrate, an overlying layer of an ink releasable material selected from the group consisting of silicone elastomers and heterophase polymeric compositions having a silicone phase, and an ink receptive image on said layer, said image comprising a heterophase polymeric composition having a silicone phase.

25. A printing master having image areas of ink receptivity and nonimage areas of ink releasability comprising; a substrate, an overlying layer of an organopolysiloxane copolymer with a particulate image pattern on said layer providing ink receptive image areas, said image pattern comprising a heterophase polymeric composition having a silicone phase and an added ink receptive component.

26. A printing master as set forth in claim 25 wherein said organopolysiloxane copolymer comprises a copolymer of an organopolysiloxane and a polymeric material in an amorphous state having a glass transition temperature of at least about ambient temperature.

27. A printing master as set forth in claim 26 wherein said organopolysiloxane copolymer is selected from the group consisting of diblock and multiblock organopolysiloxane copolymers.

28. A printing master as set forth in claim 27 wherein said diblock and multiblock copolymers comprise copolymers of an organopolysiloxane and polystyrene.

29. A printing master as set forth in claim 27 wherein said diblock and multiblock copolymers comprise copolymers of an organopolysiloxane and poly ($\alpha$-methylstyrene).

30. A printing master as set forth in claim 25 wherein an adhesive interface layer is provided between said layer of organopolysiloxane copolymer and said substrate.

31. A printing master as set forth in claim 25 wherein said organopolysiloxane copolymer comprises between about 95 to 50 parts by weight of an organopolysiloxane.

32. A printing master as set forth in claim 25 wherein said ink receptive component is present in an amount of between about 4 and 50% by weight of said heterophase polymeric composition employed by said particulate image pattern.

33. A method of printing with a printing master comprising a layer of an ink releasable material selected from the group consisting of silicone elastomers and heterophase polymeric compositions having a silicone phase, coated on a suitable substrate and having a fused particulate image pattern on said ink releasable layer, said image pattern comprising an ink receptive heterophase polymeric composition having a silicone phase, said method of printing comprising applying ink to said fused image pattern and contacting the inked image with an image receiving surface to thereby transfer said inked image.

34. A method of printing with a master comprising a particulate image pattern comprising a heterophase polymeric composition having a silicone phase and an ink receptive component fused to a layer of an ink releasable heterophase polymeric composition having a silicone phase, on a suitable substrate, said method of printing comprising applying ink to said image pattern and contacting said inked image with an image receiving surface to thereby transfer said image.

35. A method of printing with a printing master comprising a particulate image pattern comprising a heterophase polymeric composition having a silicone phase fused to a layer of an organopolysiloxane copolymer on a suitable substrate, said method of printing comprising applying ink to said image pattern and contacting said inked image with an image receiving surface to thereby transfer said inked image.

* * * * *